US006917007B2

(12) United States Patent
Hirai et al.

(10) Patent No.: US 6,917,007 B2
(45) Date of Patent: Jul. 12, 2005

(54) METAL DOME SHEET, ITS MANUFACTURING METHOD, AND METAL DOME SYSTEM

(75) Inventors: Koji Hirai, Tokyo (JP); Takashi Matsukawa, Tokyo (JP); Kenji Ninomiya, Tokyo (JP); Masatomo Koshihara, Tokyo (JP)

(73) Assignee: Fujikura, Ltd., Tokyo (JP)

( * ) Notice: Subject to any disclaimer, the term of this patent is extended or adjusted under 35 U.S.C. 154(b) by 0 days.

(21) Appl. No.: 10/479,743

(22) PCT Filed: Jun. 7, 2002

(86) PCT No.: PCT/JP02/05653

§ 371 (c)(1),
(2), (4) Date: Dec. 5, 2003

(87) PCT Pub. No.: WO02/101776

PCT Pub. Date: Dec. 19, 2002

(65) Prior Publication Data

US 2004/0234072 A1 Nov. 25, 2004

(30) Foreign Application Priority Data

Jun. 7, 2001 (JP) ..... 2001-173264

(51) Int. Cl.[7] ..... H01H 13/70
(52) U.S. Cl. ..... 200/516; 200/406; 200/515
(58) Field of Search ..... 200/512–517, 200/406, 341, 345; 29/622

(56) References Cited

U.S. PATENT DOCUMENTS

| | | | | |
|---|---|---|---|---|
| 4,689,879 A | | 9/1987 | Fowler | |
| 5,924,555 A | * | 7/1999 | Sadamori et al. | 200/512 |
| 6,373,008 B1 | * | 4/2002 | Saito et al. | 200/310 |
| 6,548,779 B2 | * | 4/2003 | Takahashi et al. | 200/516 |
| 6,593,537 B2 | * | 7/2003 | Teruyama et al. | 200/515 |
| 6,595,653 B2 | * | 7/2003 | Saito et al. | 362/84 |
| 6,604,278 B2 | * | 8/2003 | Sera et al. | 29/622 |
| 6,730,869 B2 | * | 5/2004 | Teruyama et al. | 200/516 |
| 6,768,074 B2 | * | 7/2004 | Iwama | 200/515 |

FOREIGN PATENT DOCUMENTS

| | | |
|---|---|---|
| EP | 1 065 687 A | 1/2001 |
| EP | 1 065 688 A | 1/2001 |
| FR | 2 762 134 A | 10/1998 |

* cited by examiner

*Primary Examiner*—Michael A. Friedhofer
(74) *Attorney, Agent, or Firm*—Sughrue Mion, PLLC

(57) ABSTRACT

In a metal dome sheet to be hermetically adhered to a plurality of metal domes disposed at electrodes on a substrate and to other portions of the substrate via an adhesive layer, the present invention provides an adhesive layer removed portion at a portion of the adhesive layer between at least two adjacent metal domes as an air escape portion. Accordingly, it is possible to obtain a thin and light switch panel, which is also excellent in water resistance and dust resistance.

9 Claims, 10 Drawing Sheets

METAL DOME SHEET, ITS MANUFACTURING METHOD, AND METAL DOME SYSTEM

TECHNICAL FIELD

The present invention relates to metal dome sheets for low-profile operating switch panels for use in electric and electronic instruments such as mobile telephones.

BACKGROUND ART

Various types of low-profile operating switch panels have been already proposed. For example, there are low-profile operating switch panels having structures as shown in FIG. 1 and FIG. 5.

In a switch panel $SP_1$ shown in FIG. 1, a plurality of metal domes 12 to be disposed at electrodes 11 on a substrate 10 are fixed with a film 14 adhered to the substrate 10 via an adhesive layer 13.

Here, the metal dome 12 is usually made of an elastic hemispheric cap of metal. Moreover, as shown in FIG. 2 for example, the metal dome 12 is disposed on an electrode 11 including a pair of an arc electrode layer 11*a* and a straight electrode layer 11*b* guided therein (a thickness of this layer is made slightly lower than the electrode layer 11*a*, or an insulating layer is provided thereon). In a free state as shown in FIG. 3, if a user presses the metal dome 12 from above the film, then the cap is crushed down and a switch is turned on as shown in FIG. 4. When a finger is released, the cap restitutes and the switch is turned off.

Meanwhile, in a switch panel $SP_2$ shown in FIG. 5, a plurality of metal domes 12 to be disposed at electrodes 11 on a substrate 10 are fitted into relevant holes 15*a* on a spacer film 15 and fixed with a film 14 adhered to the spacer film 15 via an adhesive layer 13.

In any cases, upon pressing the above-described metal dome 12, air inside the dome is naturally compressed and thereby generates repulsion. Therefore, in order to provide the user with comfortable operation feeling, the air inside the dome needs to be evacuated temporarily out of the dome.

Accordingly, since each of the metal domes 12 constitutes an independent sealed space in the switch panel $SP_1$ in FIG. 1, air escape holes (not shown) communicating with the inside of the dome are provided on the adhesive layer 13 and on the film 14, or alternatively, such an air escape hole is provided on the substrate 10, where the air inside the dome is set open to outside air.

However, if such an air escape hole is provided and the air inside the dome is set open to the outside air, there is a problem that humidity or dust in the outside air is caught into the switch panel $SP_1$.

Meanwhile, regarding the switch panel $SP_2$ in FIG. 5, the spacer film 15 can be simply placed on the substrate 10. Then, upon pressing the metal dome 12, the air compressed inside the dome is dispersed temporarily in the periphery thereof through gaps under the spacer film 15. Therefore, the switch panel $SP_2$ has an advantage that provision of an air escape hole is not particularly required, and so forth.

However, installation of the spacer film 15 incurs an increase in the number of components and an increase in assembly steps, whereby a cost rise is incurred. Moreover, there is also a problem that a thickness, a weight or the like of an end product is also increased. Needless to say, another problem of catching humidity or dust in the outside air is also incurred if peripheral portions of the spacer film 15 are made open to the outside air.

DISCLOSURE OF THE INVENTION

The present invention is made in consideration of the foregoing problems.

Specifically, a metal dome system according to the present invention basically has a structure similar to that shown in FIG. 1, in which an adhesive layer removed portion is provided at an adhesive layer portion between at least two adjacent metal domes so as to constitute an air escape portion. Alternatively, only part of the metal dome such as an upper portion thereof is adhered and fixed with an adhesive layer; meanwhile, a peripheral portion of a disposed region of each metal dome is hermetically sealed, whereby air inside the dome can be evacuated easily and penetration of humidity or dust in the outside air can be prevented.

Moreover, a metal dome system according to the present invention is designed such that the air escape portion or a partial adhesive layer is fabricated easily and with high accuracy upon formation of the adhesive layer, by a printing process used in the process technology for printed boards or the like.

A first aspect of the present invention provides a metal dome system that is comprised of a substrate provided with electrodes, a plurality of metal domes disposed at the electrodes on the substrate, an adhesive layer covering the metal domes and hermetically adhered to the substrate at a peripheral portion around a disposed region of the metal domes, and a metal dome sheet covering the adhesive layer, wherein each of the plurality of the metal domes is comprised of an adhered top portion adhered to the metal domes at only near tops of the metal domes so as to constitute an air escape portion defined by a the substrate, the metal domes, and the adhesive layer.

A second aspect of the present invention provides a metal dome system according to the first aspect, in which the adhered top portion has one of a circular shapes, cross shapes, simple straight band shapes, and radial shapes.

A third aspect of the present invention provides a metal dome system according to the first aspect, in which the adhered top portion is formed by a printing process.

A fourth aspect of the present invention provides a metal dome system that is comprised of a substrate provided with electrodes, a plurality of metal domes disposed at the electrodes on the substrate, an adhesive layer covering the metal domes and hermetically adhered to the substrate at a peripheral portion around a disposed region of the metal domes, a metal dome sheet covering the adhesive layer, and an air escape communicating passage being provided between at least two pieces of the metal domes adjacent to each other.

BEST MODE FOR CARRYING OUT THE INVENTION

Figure 7:
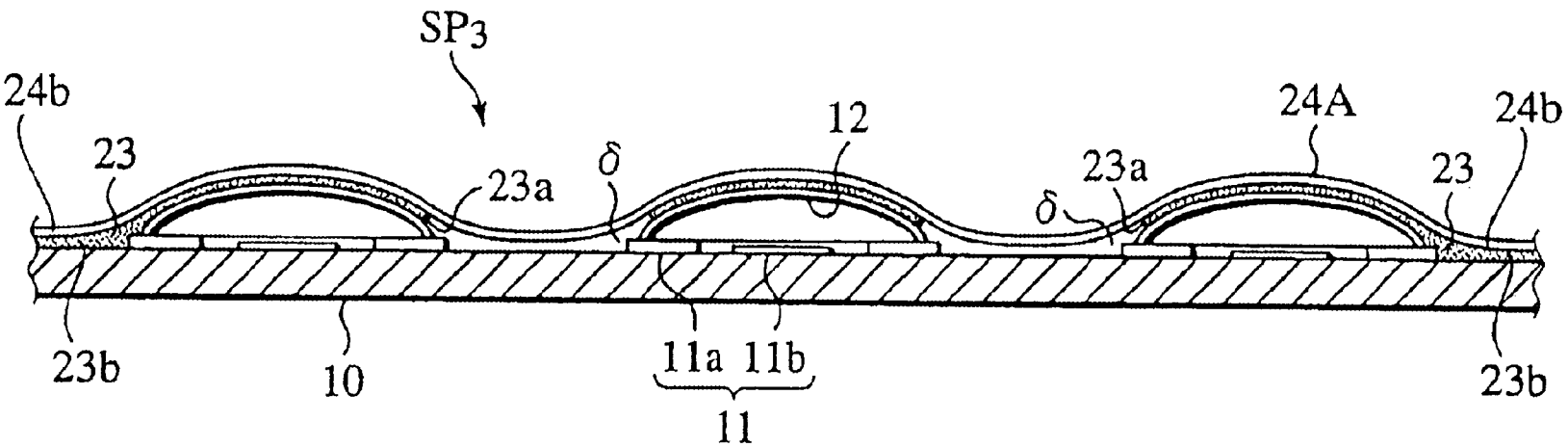
FIG. 7 is a vertical cross section showing one example of a low-profile operating switch panel adopting a metal dome system according to the present invention.

FIG. 7 shows one example of a low-profile operating switch panel adopting a metal dome system according to the present invention.

Figure 1:
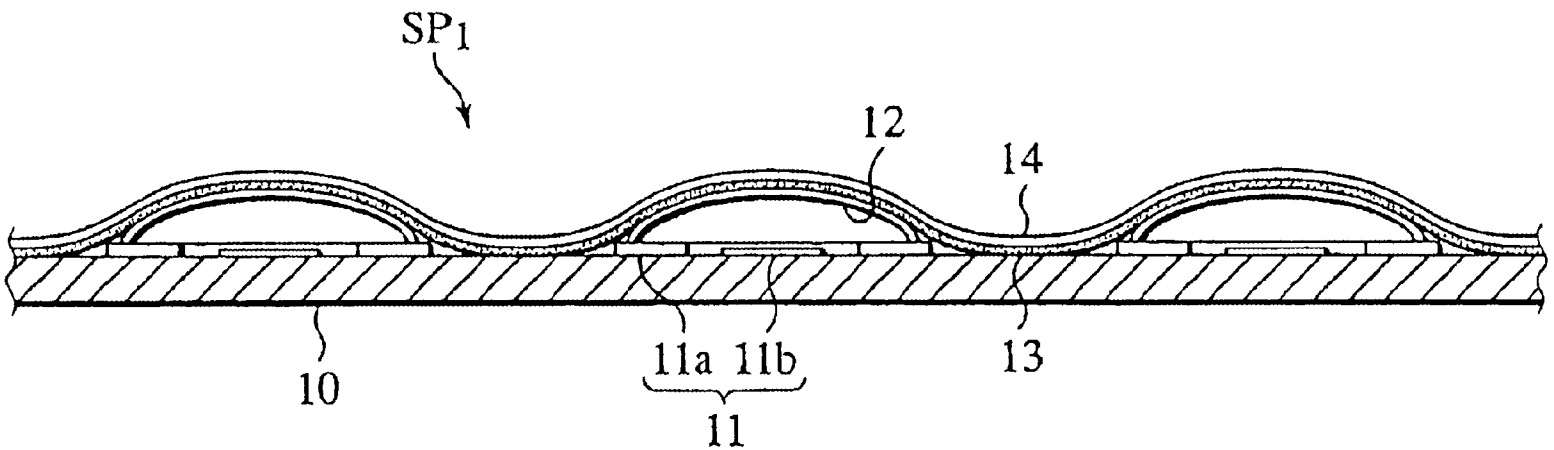
FIG. 1 is a vertical cross section showing a conventional switch panel.
Figure 2:
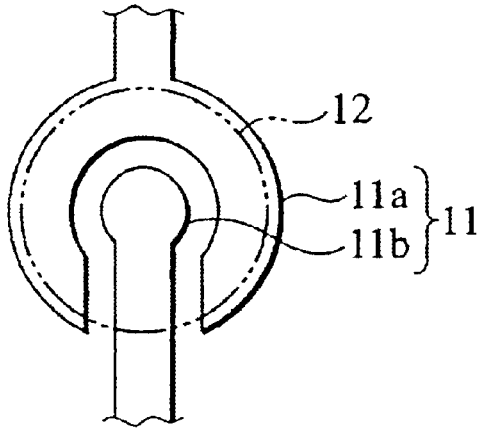
FIG. 2 is a plan view showing an electrode in the switch panel of FIG. 1.
Figure 3:
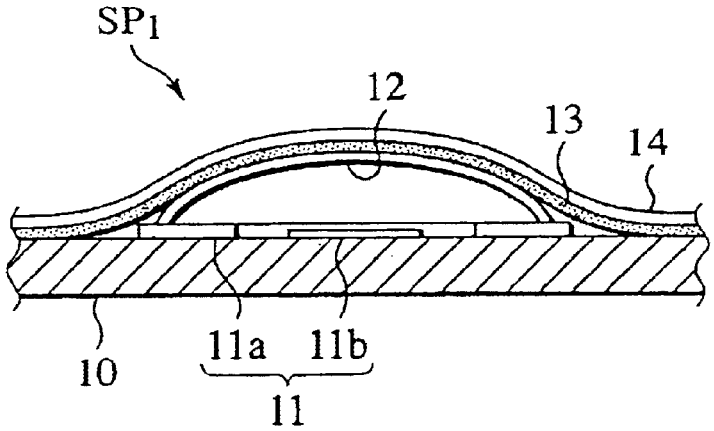
FIG. 3 is a vertical cross section showing a free state of a metal dome in the switch panel of FIG. 1.
Figure 4:
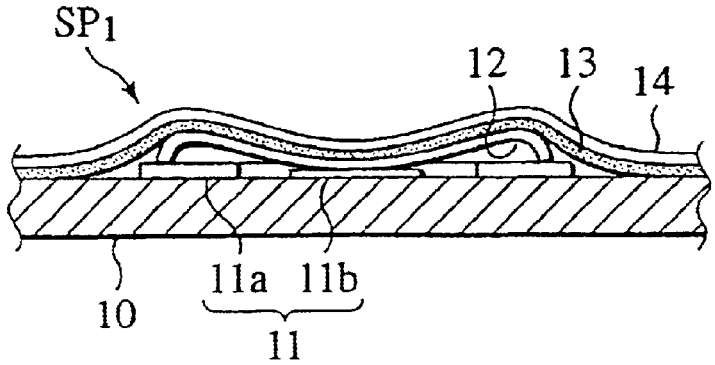
FIG. 4 is a vertical cross section showing a pressed state of the metal dome in the switch panel of FIG. 1.
Figure 5:
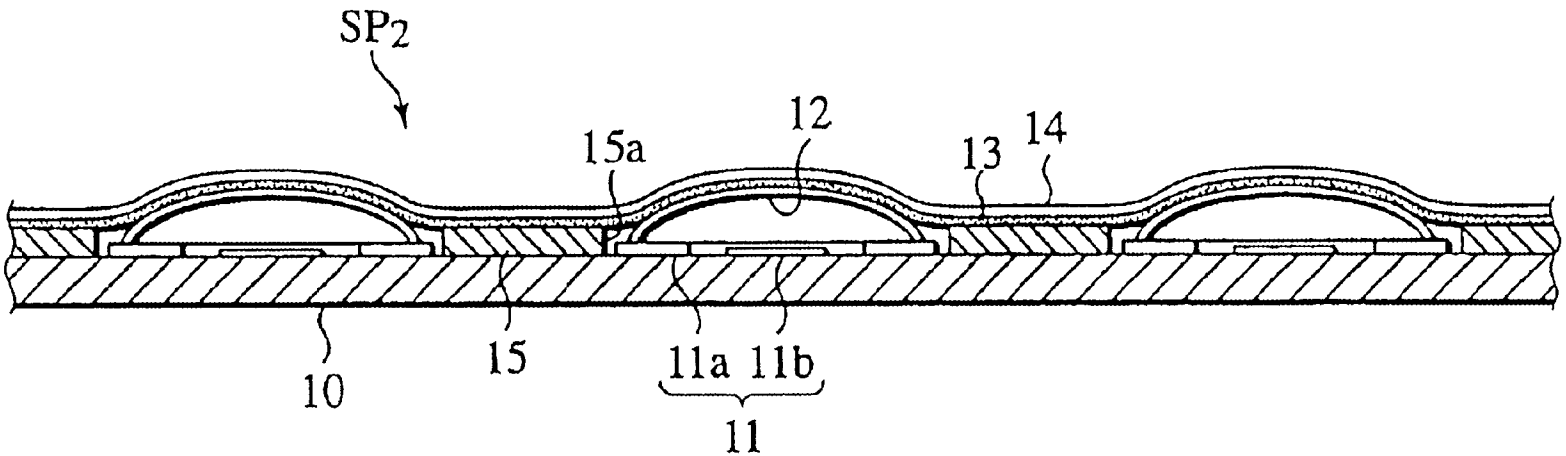
FIG. 5 is a vertical cross section showing another conventional switch panel.
Figure 6:
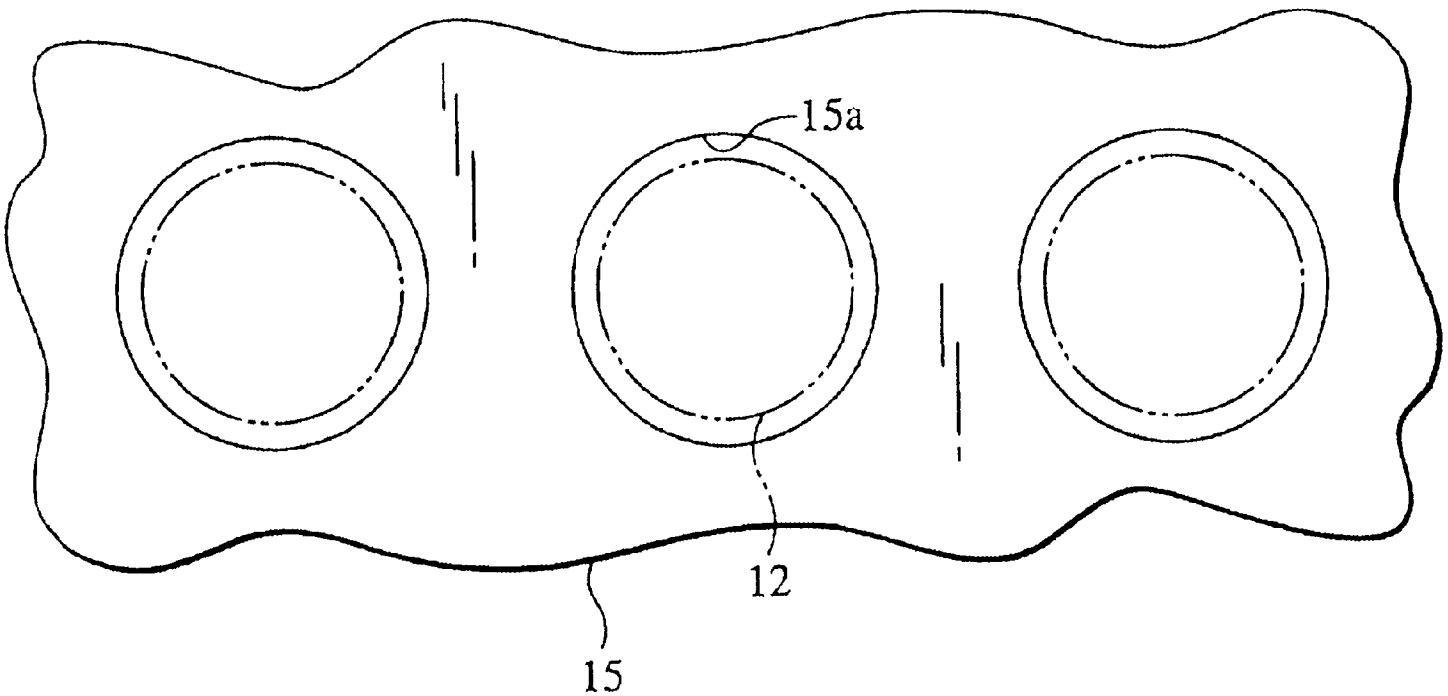
FIG. 6 is a partial plan view showing a spacer film in the switch panel of FIG. 5.

Basically, this switch panel $SP_3$ has almost the same structure as the switch panel $SP_1$ shown in FIG. 1. However, in the switch panel $SP_3$, a constitution of an adhesive layer 23 to be formed on one side of a metal dome sheet 24A is largely different from the relevant constitution in the switch panel $SP_1$. Note that a substrate 10, electrodes 11 and metal domes 12 of FIG. 7 severally have the same structures as those in FIG. 1.

Figure 8:
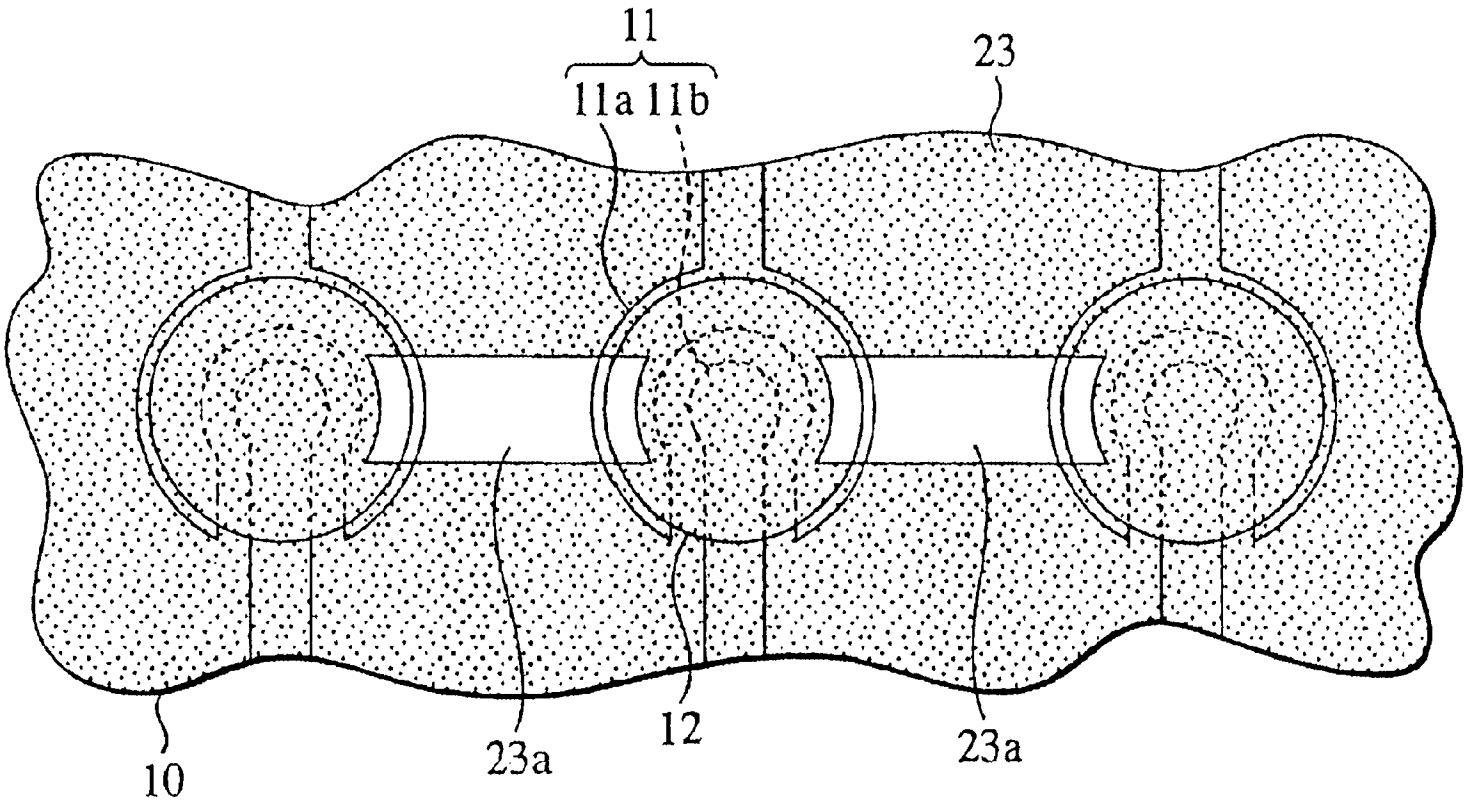
FIG. 8 is a partial plan view of the switch panel of FIG. 7 showing portions below an adhesive layer thereof.
Figure 9:
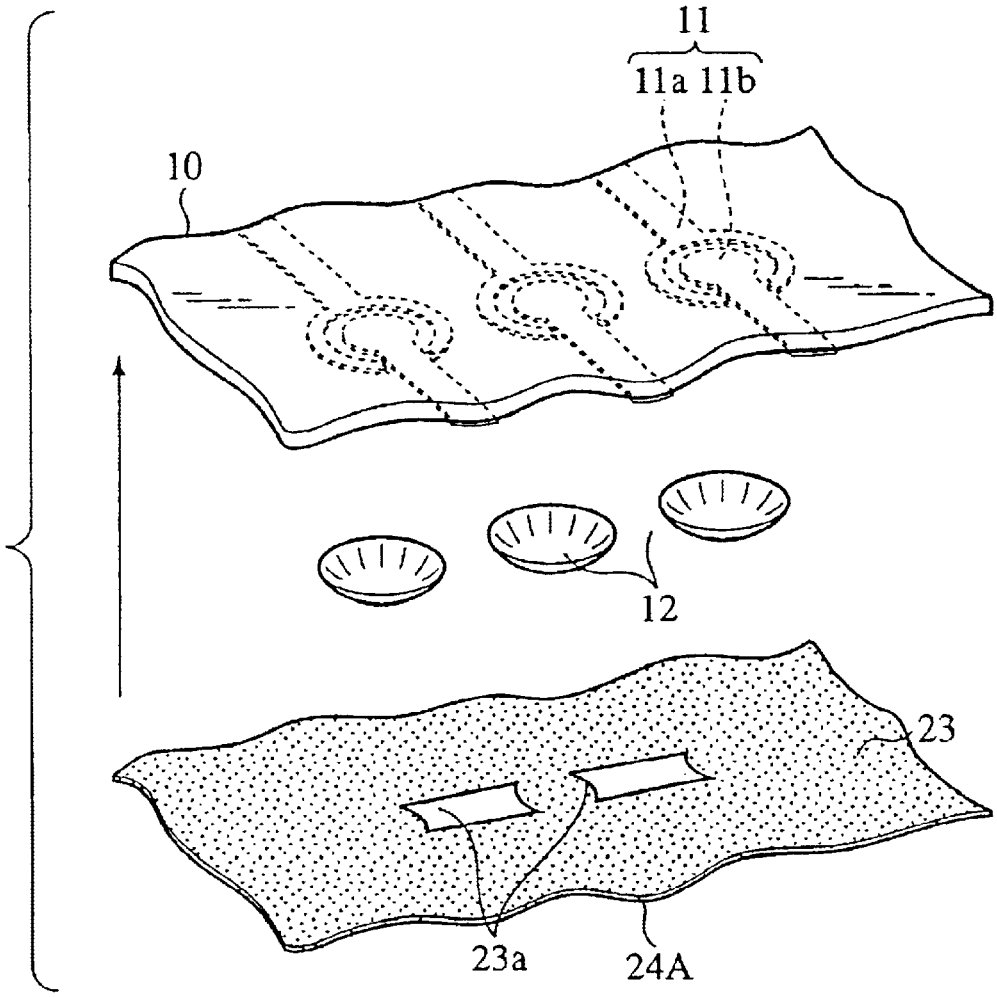
FIG. 9 is an exploded perspective view of the switch panel of FIG. 7 from an opposite direction.

In other words, the metal dome sheet 24A of the present invention is made of a film such as a polyethylene telephthalate. Moreover, as shown in FIG. 8 and FIG. 9, an adhesive layer removed portion 23*a* is provided on part of the adhesive layer 23 between at least two adjacent metal domes 12 to constitute a sort of a passage, and such a passage is defined as an air escape portion (passage) δ. Also, a peripheral portion 24*b* of a disposed region of metal domes 12 is hermetically adhesive to a substrate 10 through a peripheral portion 23*b* of the adhesive layer 23.

Therefore, when a user presses the metal dome 12 in the center of FIG. 7, for example, air inside the dome is evacuated temporarily toward the metal domes 12 on the right and the left through the air escape portions δ on the right and the left. Normally in the switch panel of this type, two longitudinally or laterally adjacent switches are seldom pressed at the same time. Accordingly, evacuation of the air is carried out smoothly. Even if two adjacent switches are pressed simultaneously, smooth evacuation of the air is secured by providing additional air escape portions δ, which are constituted as the adhesive layer removed portions 23, so as to communicate with more metal domes 12. Of course, it is satisfactory if an appropriate number of the metal domes 12 are communicated with one another in response to volumes of the metal domes 12 or the like.

In any cases, the user can enjoy comfortable operation feeling by this air escape portions δ. Moreover, since large loads (stress) on the periphery are reduced by provision of the air escape portions δ, separation of adhered portions are suppressed, for example. In addition, a good damage prevention effect on the switch panel $SP_3$ itself is also obtained.

Moreover, each of the air escape portions δ is designed basically as an independent sealed space. In other words, the air escape portion δ is communicated only with the metal domes 12.

That is, since a peripheral portion 24*b* of a disposed region of metal dooms 12 is hermetically adhesive to a substrate 10 through a peripheral portion 23*b* of the adhesive layer 23, the air escape portion δ does not include any portions made open to outside air. Accordingly, if penetration of humidity or dust in the outside air is avoided upon assembly, the air escape portion δ can maintain such a state stably. In other words, it is possible to obtain an excellent switch panel which does not incur deterioration with time.

Moreover, upon fabrication of this switch panel $SP_3$, although modes for forming the adhesive layer removed portions 23*a* as well as the adhesive layer 23 on one side of the metal dome sheet 24A as shown in FIG. 9 are not particularly limited, a printing process used in the process technology for printed boards or the like is suitable.

In this way, it is possible to form the adhesive layer removed portions 23*a* easily in accurate shapes. High accuracy in the adhesive layer removed portions 23*a* also means high accuracy in the adhesive layer 23. Accordingly, the respective metal domes 12 can be adhered by mutually equal adhesive power without unevenness. In other words, it is possible to obtain a high-quality switch without unevenness in operation feeling.

Figure 10:
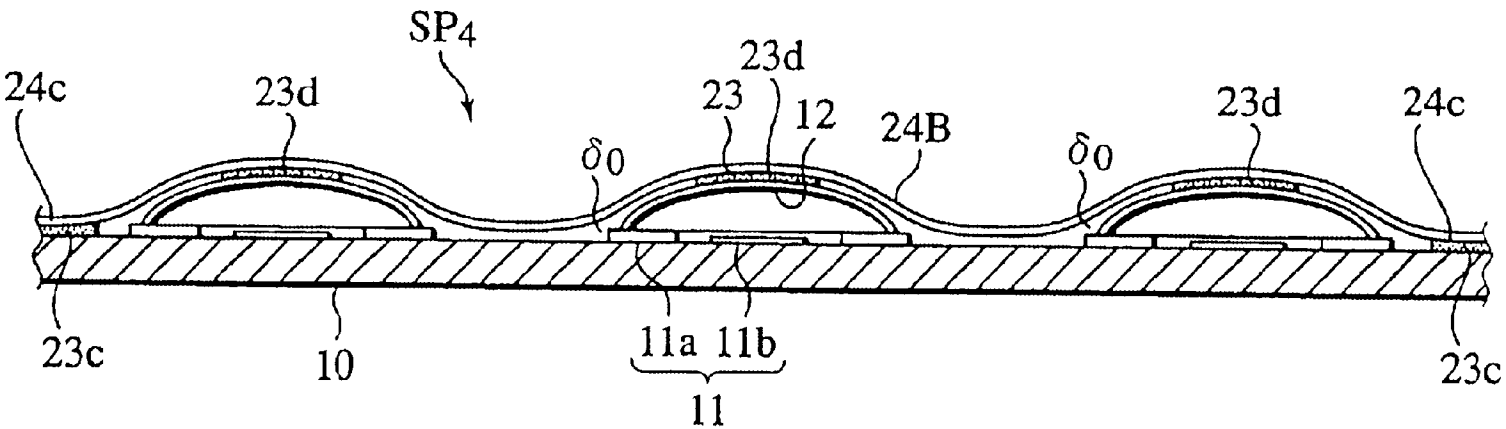
FIG. 10 is a vertical cross section showing another example of a low-profile operating switch panel adopting a metal dome system according to the present invention.

FIG. 10 shows another example of a low-profile operating switch panel adopting a metal dome system according to the present invention.

Basically, this switch panel $SP_4$ also has almost the same structure as the switch panel $SP_1$ shown in FIG. 1. However, in the switch panel $SP_4$, a constitution of an adhesive layer 23 to be formed on one side of a metal dome sheet 24B is largely different from the relevant constitution in the switch panel $SP_1$. Note that a substrate 10, electrodes 11 and metal domes 12 of FIG. 10 severally have the same structures as those in FIG. 1.

Figure 11:
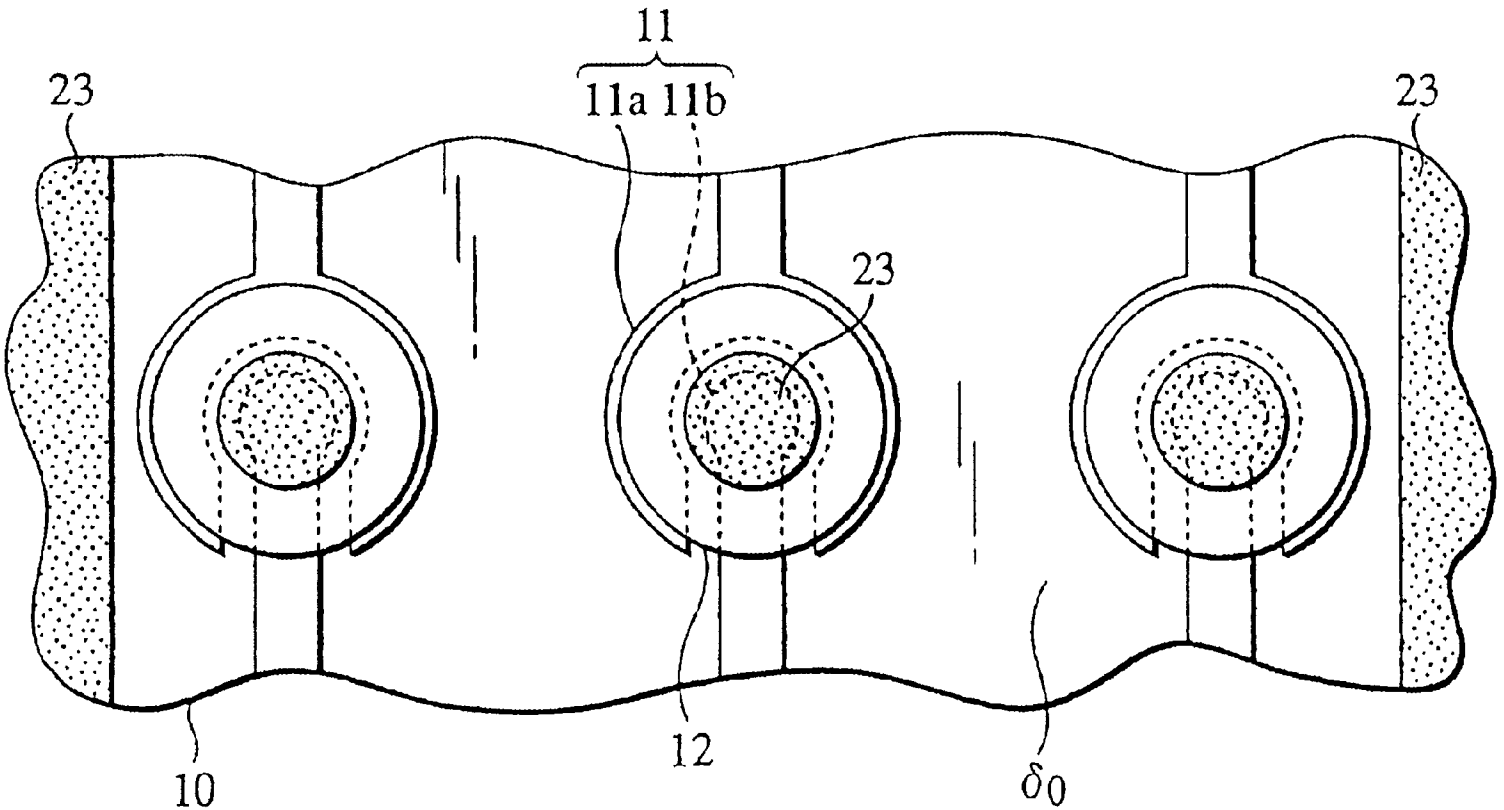
FIG. 11 is a partial plan view of the switch panel of FIG. 10 showing portions below an adhesive layer thereof.
Figure 12:
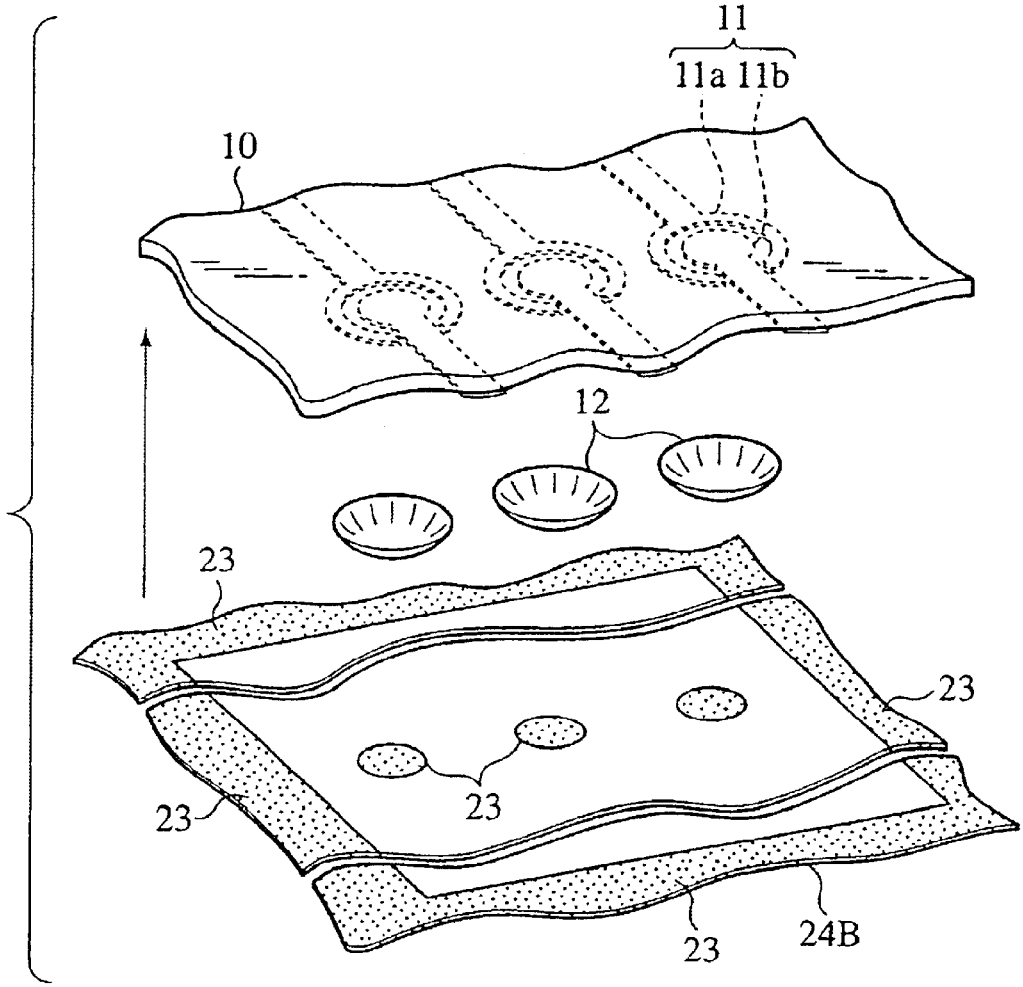
FIG. 12 is an exploded perspective view of the switch panel of FIG. 10 from an opposite direction.

In other words, the metal dome sheet 24B of the present invention is also made of a film such as a polyethylene telephthalate. Moreover, as shown in FIG. 11 and FIG. 12, circular adhesive layers 23 are provided on upper faces of the metal domes 12, near tops thereof, for example, whereby respective metal domes 12 are fixed. Meanwhile, an adhesive layer 23*a* is also provided in the peripheral portion 24*c* of a disposed region of the metal domes 12 and such an adhesive layer 23*a* is adhered to the substrate 10.

In this way, portions without the adhesive layers 23 collectively constitute a sort of a wide air escape portion (passage) $\delta_0$. Moreover, the disposed region of the respective metal domes 12 is hermetically sealed by adhesion of the periphery portion 23*c* of adhesive layer 23*a*. Note that shapes of the adhesive layers 23 on the near tops 23*d* (defined as an adhered top portion 23*d*) of the metal domes 12 are not limited to circular shapes, but cross shapes, simple straight band shapes, radial shapes and the like may be also acceptable. Moreover, sizes of the above-mentioned various forms of adhesive layers 23 including those in circular shapes will be decided as appropriate in consideration of retention force against the metal domes 12, which are subjected to frequent pressing operations.

Owing to the constitution as describe above, when a user presses the metal dome 12 in the center of FIG. 10, for example, air inside the dome is evacuated temporarily toward the metal domes 12 communicated thereabout through the air escape portions $\delta_0$ in the vicinity thereof. In this case, an area of the air escape portion $\delta_0$ is substantially large; accordingly, smooth evacuation of the air is carried out without major problems even if multiple switches are pressed simultaneously.

In other words, the user can enjoy more comfortable operation feeling by this air escape portions $\delta_0$. Naturally, since large loads (stress) on the periphery are reduced by provision of the air escape portions $\delta_0$, separation of adhered portions are suppressed, for example. In addition, a good damage prevention effect on the switch panel $SP_4$ itself is also obtained.

Moreover, a peripheral portion 24*c* of this metal dome sheet 24B is hermitically sealed and there are no portions made open to outside air. Accordingly, if penetration of humidity or dust in the outside air is avoided upon assembly, the air escape portion δ can maintain such a state stably. In other words, it is possible to obtain an excellent switch panel which does not incur deterioration with time.

Moreover, upon fabrication of this switch panel $SP_4$, although modes for forming the adhesive layers 23 partially on one side of the metal dome sheet 24B as shown in FIG. 12 are not particularly limited, a printing process used in the process technology for printed boards or the like is suitable.

In this way, it is possible to form the adhesive layers 23 easily in accurate shapes. By forming the adhesive layers 23 in high accuracy, the respective metal domes 12 can be adhered by mutually equal adhesive power without unevenness. In other words, it is possible to obtain a high-quality switch without unevenness in operation feeling.

Although the foregoing embodiments have been described based on the case where there are three metal domes 12, it is needless to say that the present invention is not limited thereto. In other words, the present invention is also applicable to a switch panel provided with more or less than three metal domes. In addition, shapes or structures of the electrodes 11 are not limited to those described in the foregoing embodiments.

INDUSTRIAL APPLICABILITY

As it is made clear from the foregoing description, according to the metal dome sheet of the present invention, it is possible to obtain a low-profile operating switch panel with less thickness and less weight owing to reduction in the number of components, which is also excellent in water resistance and dust resistance.

Moreover, comfortable operation feeling can be obtained upon pressing the metal domes, owing to formation of the air escape portion or formation of the partial adhesive layers on the upper faces of the metal domes.

Naturally, loads on the peripheral portions are reduced by provision of fine air escape mechanisms. Therefore, a good damage prevention effect on the switch panel itself is also obtained.

Moreover, according to the method of fabricating the metal dome sheet of the present invention, formation of the adhesive layers is carried out by a printing process used in the process technology for printed boards or the like. Accordingly, it is possible to form the adhesive layers easily and in high accuracy. Therefore, the respective metal domes can be adhered by mutually equal adhesive power without unevenness. As a result, it is possible to obtain a high-quality switch without unevenness in operation feeling.

What is claimed is:

1. A metal dome system comprising:

a substrate provided with electrodes;

metal domes disposed individually above the electrodes on the substrate;

an adhesive layer covering the metal domes and a peripheral portion of the substrate around a region where the metal domes are arranged;

a metal dome sheet covering the adhesive layer and the substrate; and an air escape passage defined by the substrate, metal domes and the metal dome sheet where no adhesive layer is provided, wherein the adhesive layer hermetically seals the metal dome sheet to the substrate along the periphery of the substrate to make the air escape passage airtight, and individually connects the metal domes to the metal dome sheet via adhered top portions.

2. The metal dome system according to claim 1, wherein the adhered top portions have one of a circular shapes, cross shapes, simple straight band shapes, and radial shapes.

3. The metal dome system according to claim 1, wherein the adhered top portions are formed by a printing process.

4. The metal dome system according to claim 1, wherein the air escape passage connects adjacent ones of the metal domes.

5. The metal dome system according to claim 1, wherein the metal dome sheet comprises a film.

6. The metal dome system according to claim 5, wherein the film comprises polyethylene telephthalate.

7. A metal dome system comprising:

a substrate provided with electrodes;

metal domes disposed individually above the electrodes on the substrate;

an adhesive layer covering the metal domes and a peripheral portion of the substrate-around a region where the metal domes are arranged;

a metal dome sheet covering the adhesive layer and the substrate; and an air escape communicating passage connecting adjacent ones of the metal domes, wherein:

the adhesive layer hermetically seals the metal dome sheet to the substrate along the periphery of the substrate to make the air escape communicating passage airtight, and individually connects the metal domes to the metal dome sheet via adhered top portions.

8. The metal dome system according to claim 7, wherein the metal dome sheet comprises a film.

9. The metal dome system according to claim 8, wherein the film comprises polyethylene telephthalate.

* * * * *